US006809642B1

(12) United States Patent
Brenner

(10) Patent No.: US 6,809,642 B1
(45) Date of Patent: Oct. 26, 2004

(54) EVACUATION WARNING SYSTEM FOR COMPUTER LOCAL AREA NETWORKS

(76) Inventor: Robert Harry Brenner, Sarasin Bldg 7th Floor 14 Surasak Road, Bangkok (TH), 10500

( * ) Notice: Subject to any disclaimer, the term of this patent is extended or adjusted under 35 U.S.C. 154(b) by 0 days.

(21) Appl. No.: 09/547,046

(22) Filed: Apr. 10, 2000

(51) Int. Cl.[7] ..... G08B 29/00

(52) U.S. Cl. ..... 340/506; 340/507; 340/3.1; 340/531; 340/533; 340/825.36; 340/825.49; 340/524; 340/525

(58) Field of Search ..... 340/506, 507, 340/3.1, 531, 533, 825.36, 825.49, 524, 525

(56) References Cited

U.S. PATENT DOCUMENTS 5,654,690 A * 8/1997 Ishikawa et al. ..... 340/506
6,348,860 B1 * 2/2002 Davis et al. ..... 340/525
6,529,128 B2 * 3/2003 Weng ..... 340/539.1

* cited by examiner

*Primary Examiner*—Daryl Pope
(74) *Attorney, Agent, or Firm*—Patrick Craig Muldoon

(57) ABSTRACT

The system for which this patent applies regards the application of an emergency evacuation warning and information system for a generalized computer local area network. Utilizing the existing network for information transfer and the integrated hardware of each computer workstation, namely the input devices as warning trigger methods and visual display unit to provide a personalized individual evacuation plan pertaining to the location of each computer workstation.

6 Claims, 4 Drawing Sheets

*Network Link Data Flow*

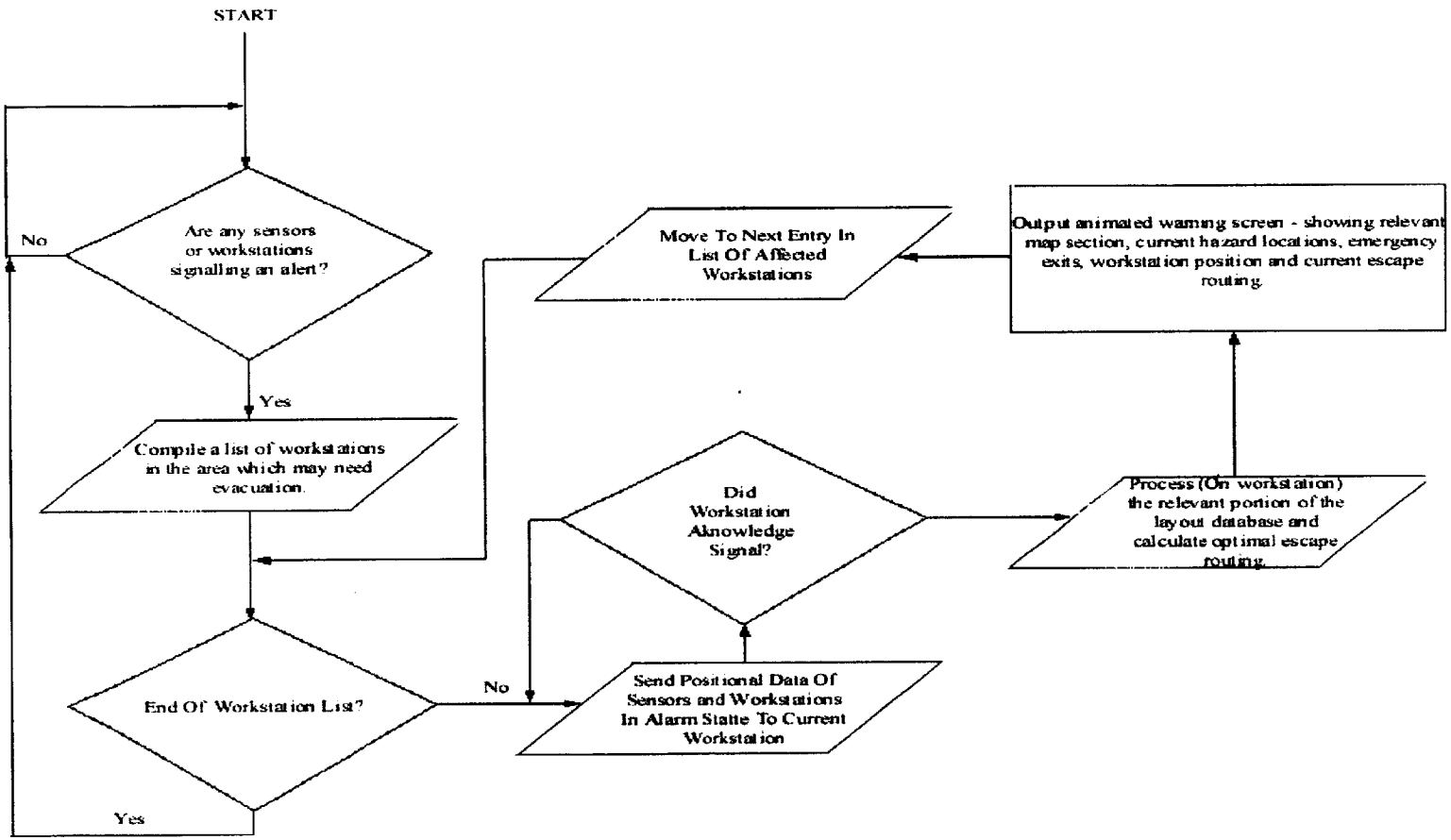
Fig 1. - Processing Flow Chart

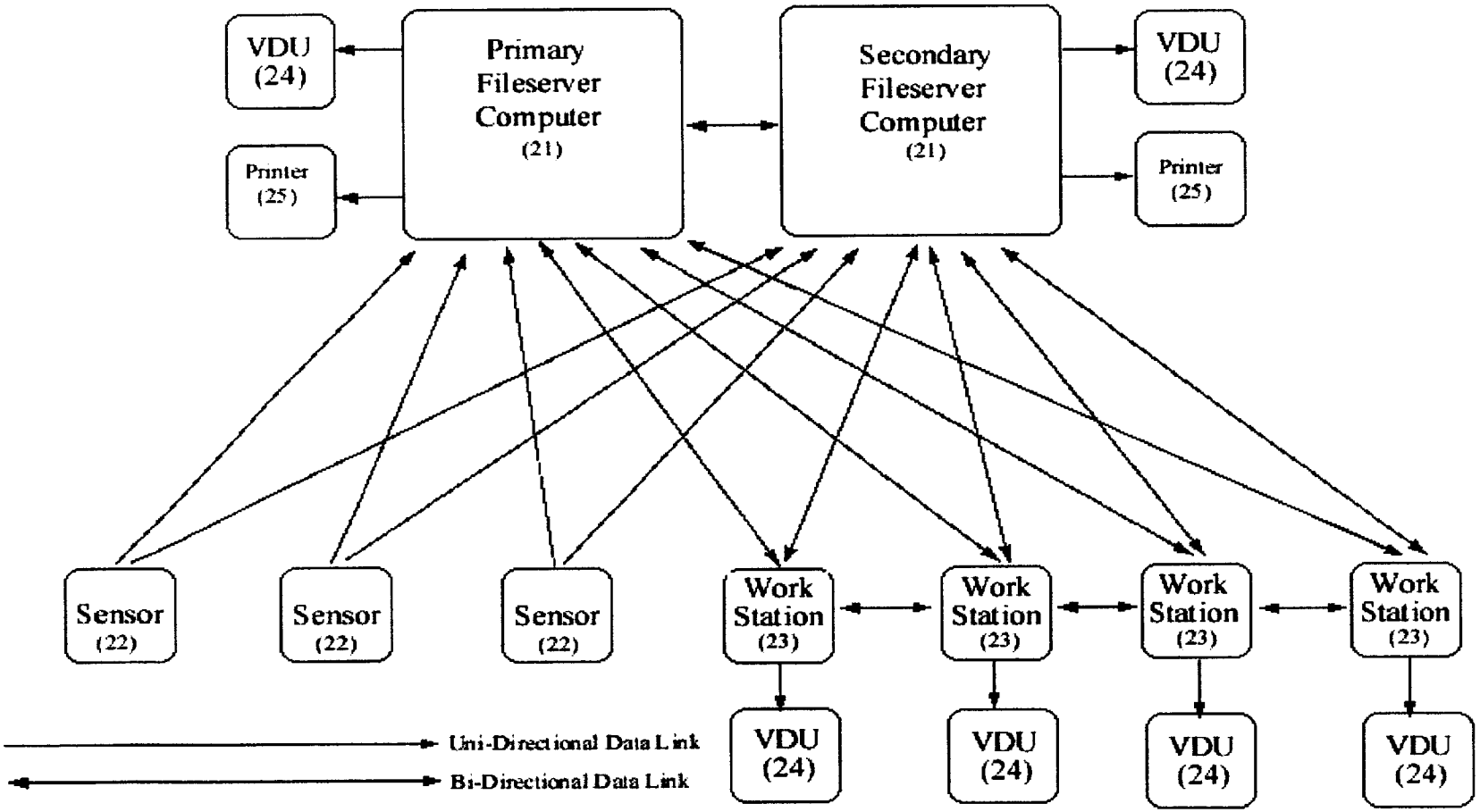
Fig 2. - Network Link Data Flow

Fig 3. - Display Example – Stylized warning screen display on a workstation.
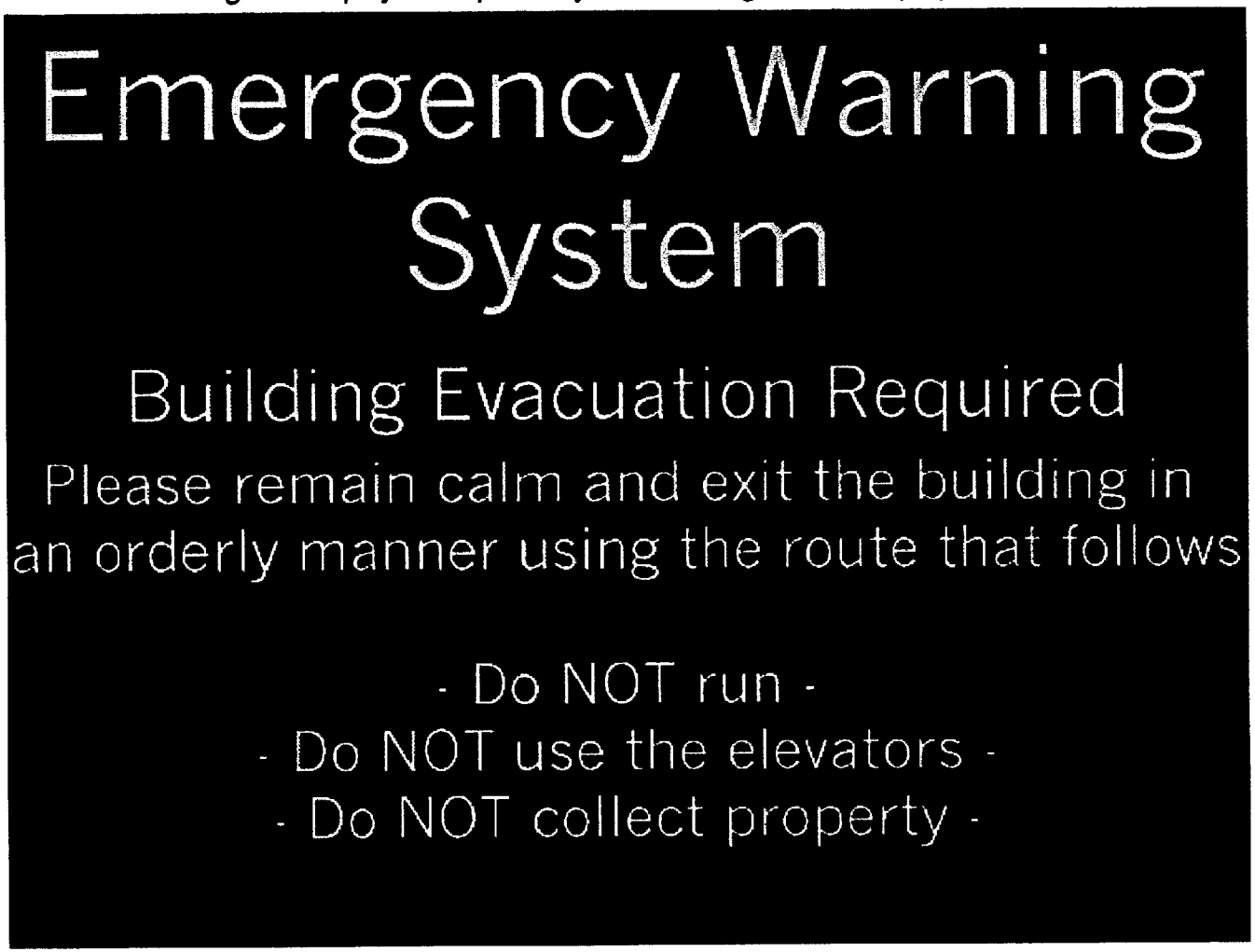

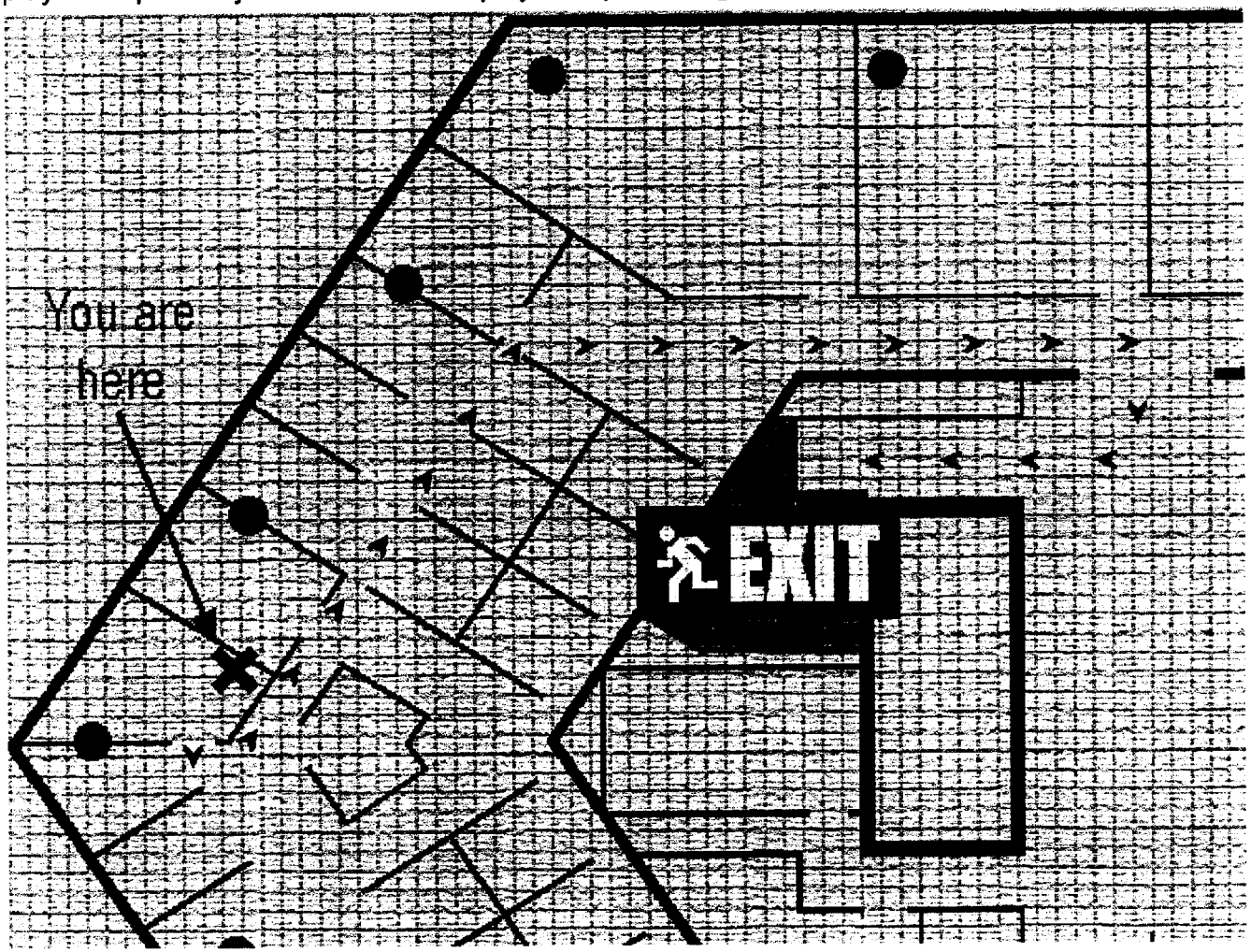
Fig. 4. Display Example – Stylized animated display escape routing on a workstation.

EVACUATION WARNING SYSTEM FOR COMPUTER LOCAL AREA NETWORKS

BACKGROUND

This subject matter relates an improved emergency alarm and evacuation warning system. In particular, the subject matter pertains to a computer-based display system for a visual emergency warning system, as well as an improved interface between an existing alarm system and the fileserver computer of the display apparatus.

Emergency warning systems in large buildings normally comprise a plurality of sensors and switches, such as, but not limited to, heat sensors, smoke detectors, radiation detectors and manually operated alarm switches which are located at predetermined positions throughout the building(s). These sensors are connected to a central control panel, which typically is located in a control room or security office. Conventional control or mimic panels may include a LED display comprising a series of LED's corresponding to respective sensors. When a particular sensor is activated, for example by detecting heat or smoke in its vicinity, a corresponding LED on the control panel signals that its associated sensor is in an alarm condition.

However, inherent and significant disadvantages of such known control panels are that the position of the activated sensor within the building is not immediately apparent from a standard control panel. When an alarm is signaled, it is necessary to look up the position of the activated sensor in a register or building plan which, in turn, may result in unacceptable delays in an emergency situation. To overcome this problem, some control panels display a brief message indicating the position of the activated sensor, e.g. "Fume-Hood C12, Lab. 103". Such information however does not give the administrator/operator an immediate indication of the position of the sensor relative to the -room or floor layout, nor does it given any information regarding the position of the activated sensor relative to other sensors in its vicinity. Such information would be useful in providing, for example, information as to the current location and probable propagation of a fire or other hazard.

When a warning is issued it normally takes the form of an auditory siren or bell which conveys no information as to the nature or location of the hazard, also assumes the person or persons can hear the warning and know how to exit the area.

There are also known fire alarm control panels, which are provided with a video display, such as a small CRT screen, to provide a graphic indication of the position of the activated sensor relative to its surroundings. Such displays are normally specific or dedicated to the particular building for which they are designed, and often display only basic information, e.g. only one screen may be available. The screen display is usually fixed or not easily changed, for example to add or vary positions of sensors. The cost of such a dedicated display is usually quite high, due to the need to custom design the display specifically for the building and/or fire protection system in question e.g. using a dedicated CAD (Computer Aided Design) program.

It is an object of the present subject matter to provide an improved emergency warning system utilizing the computing power and associated peripherals common to all local area networks.

It is a further objection of the present subject matter to provide a display system for an emergency warning system, which is relatively simple and economic to implement and of general application using existing in-situ equipment.

It is yet a further object of the subject matter to provide an improved method of displaying relevant escape routing for each component computer workstation in the local area network, given it's individual position.

It is yet a further object of the subject matter to provide a real-time adaptive evacuation solution depending on the situation.

These objects and other advantages of the disclosed subject matter will be readily apparent to one skilled in the art to which the disclosure pertains from a perusal or the claims, the appended drawings, and the following detailed description of the preferred embodiments.

BRIEF DESCRIPTION OF THE DRAWINGS

FIG. 1—shows the processing flowchart for an alert process.

FIG. 2—shows the component parts of example local area network.

FIG. 3—shows a stylized warning screen display on a workstation.

FIG. 4—shows a stylized animated display escape routing on a workstation.

DETAILED DESCRIPTION

In one broad form, the present subject matter of the disclosure provides display apparatus suitable for use with an evacuation alarm system having a plurality of computer workstations positioned at various locations within a building or area. The display apparatus comprising input means for deriving information relating to the layout of the building or area from either graphical representations of the layout or explicitly sampled positional data and for converting the point information into a computer readable form. Computer means having a memory or mass storage device for storing the information relating to the layout of the building or area. Superposition means for adding data relating to the locations of the component workstations to the information stored in the memory of the computer means. Visual display means connected to the computer means for displaying the layout of some or all of the building or area including the positions of the workstations within the layout.

According to another aspect of the subject matter of the disclosure there is provided a method of displaying the output of an evacuation warning system having a number of remote sensors and workstations at various locations within a building. The method comprising the steps of storing the information, in the memory of a computer, in a database structure representing the area in 3-dimensional space and associated structural information. Information relating to the layout of a particular part of the building can thus be drawn from the master database by any of the component workstations; adding further information to the memory means relating to the positions and/or other characteristics of the sensors or workstations; and selectively displaying on a display devise connected to the workstation the layouts of the building together with the positions of sensors superimposed on the displayed layouts.

The superimposition means comprises a software facility enabling the positions of the sensors to be superposed on the visual displays generated by each screen image file. Preferably, the data includes not only position information, but also any special details of the particular sensor an d any relevant messages for emergency personnel.

A printer and/or logging printer may suitably be connected to the fileserver computer means for providing a hard copy output of the screen images, as well as a listing of logged alarms and faults.

The computer-based display apparatus, utilized in this subject matter, enables a number of screen [[I]] images to be readily generated from the internal data representations of the layout of the building. And further enables the positions of the sensors/workstations in the building to be added, by software means, to the database structure stored in the fileserver memory. The workstation will typically comprise standard PC technology with its associated monitors, and a LAN-card and cabling to allow communication between the fileserver(s) and the workstation(s), The hardware is readily available and is generally applicable to most local area networks, as the hardware is largely of conventional design, and the layouts of each particular building can be readily input into the structure database using the above described point sampling facility, the cost of the warning display system of this subject matter is significantly less than known dedicated systems.

Furthermore, the warning display system of this subject matter will provide an immediate and visual representation of the location of the workstation within the entire area. Escape routing relevant to the position thereof whenever workstations/sensors are in an alarm condition (or fault condition) as will be described in more detail below.

The display system of the present subject matter may be retrofitted to an existing evacuation warning system.

In another embodiment therefore, the present subject matter provides a fire protection system having a number of sensors at various locations within a building, a control panel or the like connected to the sensors, and a fire alarm display system as described above, wherein the output of the control panel is connected to an interfacing card within the computer means.

As displayed in FIG. 2, the network infrastructure, and composition thereof will not be described in detail, as it is envisioned as to comprise conventional devices, which are well known in the art. The display system of the present subject matter includes a plurality of computer workstation means connected to a fileserver means. In the illustrated embodiment, the fileserver means comprises two large storage capacity fileserver type computers, there being a copy of all relevant software and associated data files on each. They would be preferably an IBM™ Netfinity™ or compatible server computer or equivalent. Each of the workstations (23), of the preferred embodiment, would be expected to have, as a workable minimum, 8 Mbytes RAM, a 100 Mbytes hard disk (or equivalent partition on one of the fileservers) a 1.44 Mbytes floppy disk drive, VGA graphics card, a serial RS-232 input/output port, parallel port and necessarily be connected to the LAN. Both fileservers (21) and workstations (23) ideally would be running under Windows™-NT operating software, or similar. Each of the workstations (23) has an associated video display (24) which preferably is a color VGA monitor. An optional printer (25) may be connected to the fileserver(s) (21).

Information relating to the layout of the area in which the warning system is to be installed, as well as the positions of the sensors (22) and workstations (23) within that area, is stored in the mass storage disk memory of the fileserver(s) (21) in one large data structure in a structure similar to that outlined below. Thus, when installing the warning system, it is necessary to first load the database file(s) into the fileserver memory. Data relating to the individual sensors (22) and workstations (23) is also stored in this memory.

A particularly advantageous feature of this subject matter is the utilization of a hardware system to digitize relevant points or nodes within the 3-dimensional locale to be used in the display system. In prior art, visual display systems for alarm warning systems, it was normally necessary to purchase a relatively expensive CAD software package for each workstation to enable the building layout to be displayed on a workstation's video screen.

The internal representation can be derived/converted from existing CAD-produced file structures, if available. However, the screen displays on each workstation will be generated independently of this CAD program. Its screen capture software can be simply transferred onto a floppy disk and taken to another computer in which a CAD program is used to generate the floor layouts of the building to which the fire alarm system relates. In this manner, a single CAD program can be used to produce the layout representation of all required buildings in the local. Alternatively, the input means may comprise a point sampling device to generate the required data from a scale drawing, blueprint, building plan, or the like.

The fileserver will now contain a comprehensive representation of the area in question in 3-dimensional space which can be used to generate a graphical display of a portion on each of the individual workstations display units (24) the layout of a particular part of the area. As described above, the internal representation of the area, typically of floor plans, generated using CAD software, but can also be point sampled images from drawings, photographs or brochures of buildings or floor layouts etc. captured using a digitizing "puck" or similar or other suitable input capture device in conjunction with data logging software. Information and data relating to the sensors are also stored, as described below.

Relating to the position and nature of the workstations (23) and sensors (22) and other related data. This can be achieved by using a data loading program which superimposes the position of the sensors (22) onto the layouts represented by the generated screen images and manipulated directly by use of cursor keys, a mouse or similar input device(s).

Typical information which is loaded into the fileservers (21) includes the serial numbers for each sensor/workstation, the type or nature of the sensor/workstation e.g. ionization, manual switch, workstation etc., and the surrounding area to which that sensor/workstation relates. The next step in the initialization procedure is to load into the fileserver (21) information at a subsequent date when the system is in operation, the data loading program enables details of a new sensor/workstation to be added to the warning display system. Using this program, the operator enters details of the sensor/workstation type.

The program will confirm the sensor/workstation type selected and then display a generated layout representing the whole area under control of the system to enable the administrator/operator to use the cursor keys, mouse or other suitable input device to place the graphical icon at the appropriate position superimposed on the layout displayed on the screen, and the 3 co-ordinate position for the sensor/workstation back calculated from the on-screen location and stored in the database, after the sensor/workstation has been positioned, the operator may add information relating to this sensor. This information is stored in the database and displayed when the sensor is in an alarm or fault condition.

To assist in adding new sensors, the devices that have already been assigned to a particular area will also be displayed as graphical icons but visually different (e.g. color) from the icon currently being manipulated. When the sensor/workstation has been correctly positioned the program will request the file name for the next screen image file, the process then being repeated until all new sensors/workstation icons have been placed.

The data loading program will also enable sensors/workstations to be removed from the database, to list all sensors/workstations recorded in the system, and to generate an graphical representation of an area local the location of a selected workstation/sensor. The administrator also has the option of specifying whether the sensor is to be displayed on the screen when inactive. Thus, some sensors may be displayed only when active or in a fault condition, while others may be displayed continuously. Furthermore, whether or not a sensor/workstation is to be displayed when inactive is selectable for each screen image file, i.e. for each level of zoom. Thus, to avoid overcrowding on the screen, it may be advisable not to show all inactive sensors/workstations on a generated screen image of the whole floor layout of a large installation, yet inactive sensors/workstations can still be displayed in an expanded screen image of a portion of the layout surrounding the activated sensor.

The related data, which is loaded for each sensor can be used to produce screen messages on the fileserver or a workstation designated as an administration machine when that sensor/workstation is actuated. For example, the screen messages may advise fire personnel to bring breathing apparatus if that sensor is positioned at a location where toxic fumes are likely to be present, or advise of other specific actions to be taken in response to a particular sensor alarm, thereby increasing safety to emergency personnel as well as building occupants.

The fileservers (21) and their associated software can be used to monitor alarms and faults as instigated by either the sensors (22) or workstations (23). It provides two separate disk-based log files, one for alarm details, and the other for fault details, which may be enabled, disabled and cleared as desired. These log files are continually appended until they are manually cleared and therefore provide extensive historical information about the sensors (22) connected to the fileservers (21) via interfacing cards.

When an alarm or fault occurs in a particular sensor, the fire alarm system of this embodiment displays the first screen image file for the activated sensor. Complete details of the device in alarm (or fault) are graphically displayed on the visual display device of the fileserver(s), preferably in high-resolution color, allowing emergency personnel to immediately identify the location of the fire. The operator also has the option of zooming in on the location of the actuated sensor (in alarm or fault) by displaying screen image files of the area proximate to the sensor, or the administrator/operator may look at details of other sensors currently in alarm and/or fault. Alarm detection overrides fault rectification. That is, if only faults have occurred up to a particular time, the detection of an alarm condition in a sensor will override whatever is currently being done on the screen at that time.

The benefits of using the proposed internal 3-dimensional representation is that any portion of the area in question can be zoomed in or out, rotated and/or "clipped" to ensure that all relevant data is clearly displayed and superfluous data is ignored. Also the data is in a much more compact form than say, bitmap images, which to show the relevant amount of detail would require many times more memory to store and therefore much more network traffic in the case of a system initiation. Each individual workstation would request the current raw data pertinent to itself and process this to generate it's own relevant evacuation routing.

The computer-based evacuation warning system of the preferred embodiment has capacity for thousands of workstations and sensors. However, it will be apparent to those skilled in the art, that the capacity of the system is directly proportional to the storage capacity of the fileserver.

A color monitor is used in the preferred embodiment for image clarity especially when manipulating the generated images although a mono chromatic screen could be used with certain display modifications obvious to someone skilled in the art. Inactive workstations/sensors (i.e., not an alarm or fault condition) can be displayed in a ghosted style, and workstations/sensors in an alarm condition can be displayed as flashing, while sensors currently in fault are shown in with a superimposed cross.

A flashing box for easy identification shows the active workstation/sensors icon whose details are currently being displayed on the screen encircled.

The device details of any active sensor will be shown in an information box at the bottom left of the screen. An information box at the bottom right of the screen displays the current number of alarms and faults detected, any custom message for the sensor as sent form the control panel.

When the alarm display system is in this display mode, the operator may select the required action by use if the keyboard function keys or, if a touch screen is being used, the operator may select desired actions by simply touching the monitor screen surface at the location of the desired option shown on the monitor screen. For example, the operator may select a display of the next screen for the current active sensor, or the previous screen. The operator may select to display the next sensor in alarm or fault condition. The display system will change from this display mode and return to a monitor mode when a reset condition is detected from the control panel. However, if alarms or faults have been detected, it is not possible to return to the monitor mode until all alarms and faults have been acknowledged at the control panel, and the panel is then finally reset.

The computer-based display system of this subject matter has several advantages over prior art systems, including:

a) The layout of the relevant area in which the emergency warning system is to be installed can be simply and economically loaded into the database. Only one commercially available CAD or scanning program would be required to initialize the complete structural and/or topographical layout of the relevant area. Alternatively, the internal representation can be derived from existing blueprints, drawings, photographs and the like by using a known point-digitizing device.

b) The positions of the computer workstations are easily input into the system and are clearly displayed on any generated screen image. As the system is software-based, additional sensors can be added to the screens, or removed, or changed in position simply by manipulating superimposed icons on the generated layout plan.

c) The display system software is of universal application, and is interchangeable between computer networks in different areas for example.

d) The display system uses conventional computer and networking technologies, which are readily available and relatively inexpensive if not pre-existing.

e) The position of all workstations and/or conventional sensors in alarm or fault condition can be immediately ascertained upon viewing the generated on-screen display. Furthermore, particular information relating to any sensor or workstation is immediately available to the administrator and warning can be conveyed to all component workstations via the network infrastructure f) This network based system can be retrofitted to existing fire/emergency warning systems which have a suitable output port with minimum modification.

g) The computer based display system is designed to allow easy economical in-situ modification for all building alterations and workstation/sensor position changes. The foregoing describes only one embodiment of the subject matter and modifications, which are obvious to those skilled in the art, may be made thereto without departing from the scope of the subject matter.

List 1: Qualities and Benefits

1. To provide a better emergency warning system for areas with an existing computer networks.
2. To provide a visual emergency warning system with benefits for the hearing impaired and persons unfamiliar with the area in question.
3. To provide a dynamic warning system that can adapt to a dynamic problem e.g. propagation of fire, smoke or other hazardous material(s).
4. To provide individual escape routings for all given sub-locations.
5. To provide a system that is economical to implement and administer using existing in-use technologies.

List 2: Primary Elements

1. An interconnected computer network (LAN) comprising at least one fileserver computer and a plurality of connected computer workstations.
2. A network messaging protocol for computer workstations and file server(s) to communicate.
3. An internal representation of the area, stored in a definite internal data structure representing the actual 2 or 3-dimensional layout of relevant area(s) and components, in the memory or data storage device of said fileserver(s).
4. Preferably, each computer workstation in said LAN possessing a graphical screen display and/or suitable input device(s).
5. A software interrupt method to over-ride the current workstation activity.

List 3: Secondary Elements

1. A secondary back-up fileserver computer.
2. A redirection in case of primary server failure.
3. Augmentation with an auditory alarm.
4. Input devices on computer workstations allowing each computer workstations to act as a manual alert triggers in it's own right.

List 4: Substitute Elements

1. Integration with current alarm systems and existing warning sensors via interfacing boards.
2. Alarm validity checking method.
3. Input devices connected to workstations.

While preferred embodiments of the present inventive system and method have been described, it is to be understood that the embodiments described are illustrative only and that the scope of the embodiments of the present inventive system and method is to be defined solely by the appended claims when accorded a full range of equivalence, many variations and modifications naturally occurring to those of skill in the art from a perusal hereof.

What is claimed is:

1. A computer network comprising at least one fileserver and a plurality of connected computer workstations positioned at various locations within an area layout, the network fileserver(s) comprising:

(i) fileserver computer means for storing data structure information relating to said area layout, sensor location (s), workstation location(s) and nodal escape routing through said area, said fileserver computer means having a memory and/or a mass data storage device;

(ii) input means for deriving said information relating to said area layout from pre-existing documentary graphic representation(s) of said area layout or direct location point-sampling, said input means storing in said memory said information as an internal data structure encapsulating the entire 3-dimensional schematic plan of said area, said input means including a scanning device for scanning said documentary graphic representation(s), a positioning digitizer for direct positional input both providing a digital output thereof into said data structure.

2. The computer network as claimed in claim 1 possessing a display apparatus comprising:

(i) superimposing means for adding graphical icons relating to said locations of said sensors, workstations and escape routings to said screen image generated from stored data in said memory: and, (ii) visual display means connected to said computer workstation means for selectively displaying a screen image so as to display a relevant portion of said layout primarily including location of computer workstation and associated escape routings and exits.

3. The computer network as claimed in claim 2, wherein said area layout comprises a building layout.

4. The computer network as claimed in claim 2, wherein said superposition means comprises a software facility for superimposing graphical icons in said positions of said workstations, sensors, on said screen image stored in said computer memory.

5. The computer network as claimed in claim 2, wherein, said superimposition means includes a facility for recording related information of said sensors/workstations such that in the event of a sensor/workstation being triggered, the stored related information of the activated sensors/workstations is displayed on said visual display means when said screen image including said activated sensors/workstations are displayed.

6. The computer network as claimed in claim 2, wherein said sensors are connected to control means, and wherein said display apparatus further comprises an interface circuit connected between said control means and said computer for providing protocol conversion of date communication between said control means and said computer.

* * * * *